United States Patent [19]

Gillette

[11] 4,312,529

[45] Jan. 26, 1982

[54] SCREW TUBE LOCK

[75] Inventor: Robert H. Gillette, Angola, Ind.

[73] Assignee: Brammall, Inc., Angola, Ind.

[21] Appl. No.: 138,710

[22] Filed: Apr. 9, 1980

[51] Int. Cl.[3] ..... B65D 33/34

[52] U.S. Cl. ..... 292/315; 292/327

[58] Field of Search ..... 242/315, 326, 307, 308, 242/319, 322, 313, 320, 327

[56] References Cited

U.S. PATENT DOCUMENTS

| | | | |
|---|---|---|---|
| 419,491 | 1/1890 | Beckwith | 292/308 |
| 1,038,183 | 9/1912 | Mueller | 292/327 X |
| 1,039,576 | 9/1912 | Mueller et al. . | |
| 1,124,005 | 1/1915 | Foreman | 292/308 |
| 1,397,101 | 11/1921 | Kelly | 292/327 |
| 1,512,632 | 10/1924 | O'Connor . | |
| 1,520,578 | 12/1924 | Kilchell | 292/307 R X |
| 1,599,189 | 9/1926 | Smith | 292/327 X |
| 1,662,863 | 3/1928 | Mueller . | |
| 1,911,060 | 5/1933 | Clark | 292/325 X |
| 2,469,592 | 5/1949 | Byer | 292/327 X |
| 2,530,899 | 11/1950 | Muller . | |
| 2,809,859 | 10/1957 | Moberg | 292/308 |
| 2,840,939 | 7/1958 | McClure | 292/307 R X |
| 3,330,586 | 7/1967 | Becker | 292/315 |

FOREIGN PATENT DOCUMENTS

| | | | |
|---|---|---|---|
| 18249 | 1/1954 | Fed. Rep. of Germany | 292/319 |

*Primary Examiner*—Richard E. Moore

*Attorney, Agent, or Firm*—Hill, Van Santen, Steadman, Chiara & Simpson

[57] ABSTRACT

A novel locking means comprising a tube which is squeezed flat so as to cease a flexible cable and wherein identification of the seal can be printed on the flatted portion with a transverse opening formed through the tube through which the free end of the flexible cable can be passed so as to be locked by a set screw threadedly received in the end of the tube and wherein the end of the set screw is reduced in cross-section so that it will break off to provide a seal that cannot be opened without cutting the cable and destroying the integrity of the seal. A second embodiment comprises a bolt with a threaded cylindrical nut formed with a transverse opening into which a set screw can be received so as to lock the bolt in the cylindrical member by engaging a reduced cross-section of the bolt and wherein the set screw also has a reduced cross-sectional portion so that it will break off when the set screw is tightened.

5 Claims, 7 Drawing Figures

FIG. 1
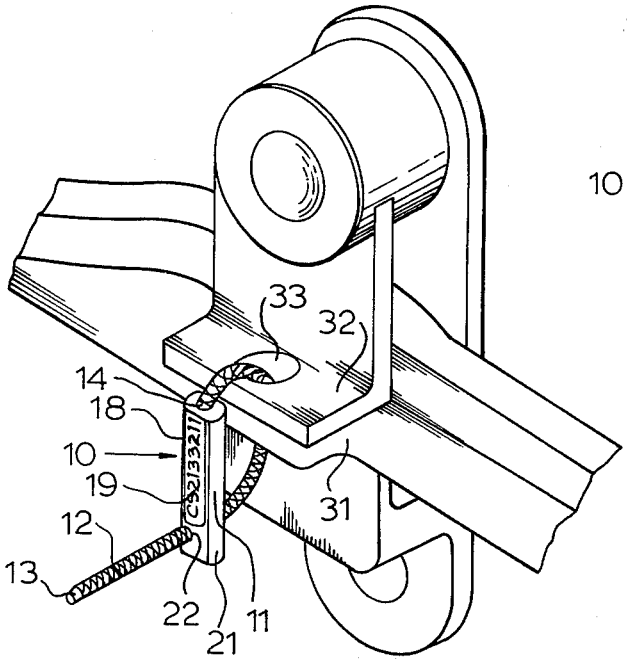
FIG. 2
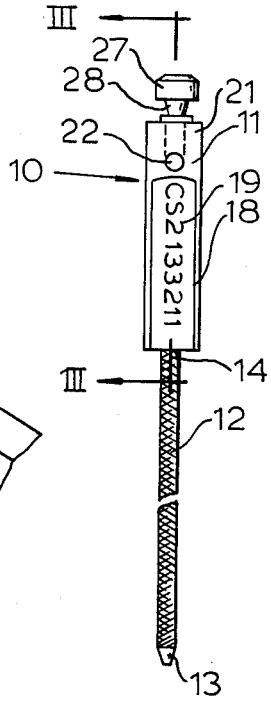
FIG. 3
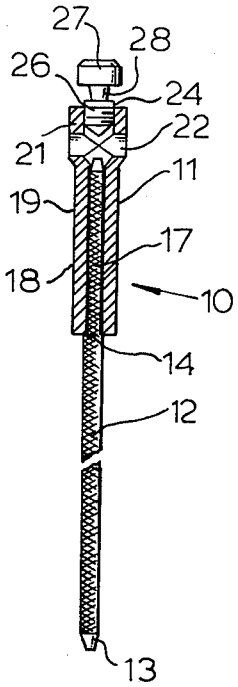
FIG. 4
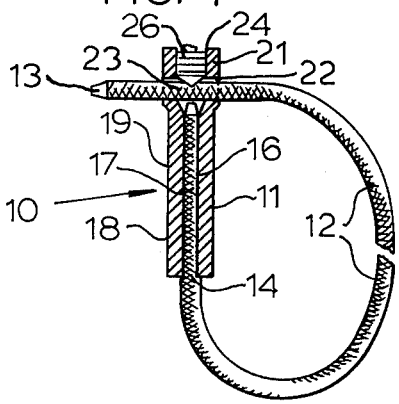
FIG. 6
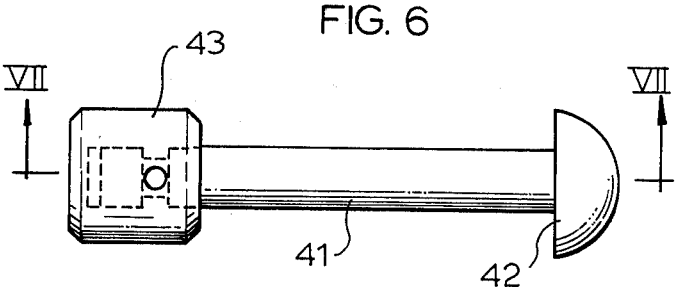
FIG. 7
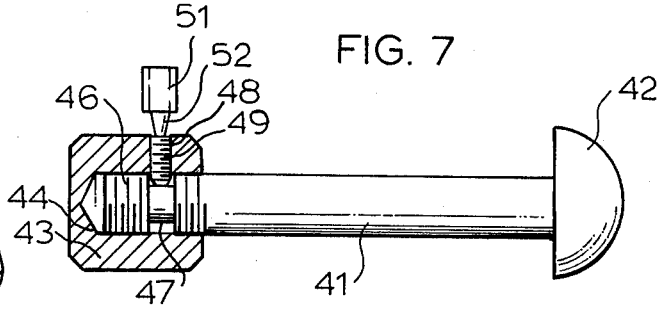
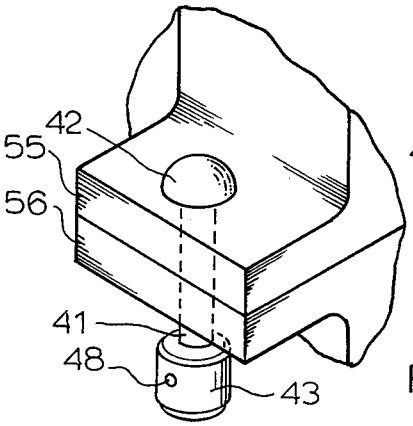
FIG. 5

SCREW TUBE LOCK

BACKGROUND OF THE INVENTION

1. Field of the Invention

This invention relates in general to security devices and particular to a cable and bolt screw tube lock.

2. Description of the Prior Art

Various cables and bolt arrangements are known for securing doors to seal them but certain of the seals can be opened and resealed so as to destroy the integrity of the seal such that merchandise can be stolen from the sealed container and then the seal replaced to prevent the user from knowing that the integrity of the seal has been violated.

SUMMARY OF THE INVENTION

The present invention provides a screw tube lock having a tubular main body portion into which one end of a flexible cable can be inserted such that the tube can be staked to lock the cable to the tubing and wherein a transverse opening is formed through the tube so that the free end of the flexible cable can pass through the transverse opening. A threaded opening is formed in the tube for receiving a twist off set screw which can be threadedly received in the threaded opening so as to engage and lock the free end of the flexible cable in the tubing. After locking has been accomplished, the head of the set screw can be twisted off so as to provide a non-removable seal. The integrity of the seal can only be broken by cutting the cable and thus the seal cannot be replaced because each of the seals carries an identification serial number and the integrity of the seal is protected.

A second embodiment of the invention comprises a bolt which is threadedly received into a cylindrical member formed with a transverse opening into which a set screw can be mounted so that its end engages into a groove formed into the threaded portion of the bolt. The set screw has a reduced cross-sectional portion so that after it has been tightened it can be broken away to prevent the cylindrical member being removed from the bolt.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure.

BRIEF DESCRIPTION OF THE DRAWINGS

FIG. 1 comprises a perspective view of the screw tube lock of the invention mounted to lock a pair of doors;

FIG. 2 is a side plan view of the screw tube lock before it has been installed;

FIG. 3 is a sectional view taken on line III—III of FIG. 2;

FIG. 4 is a sectional view through an installed screw tube lock;

FIG. 5 is a perspective view illustrating a bolt utilizing the break-away screw principal;

FIG. 6 is a side plan view illustrating the bolt of FIG. 5; and

FIG. 7 comprises a sectional view through line VII—VII in FIG. 6.

DESCRIPTION OF THE PREFERRED EMBODIMENTS

The screw tube lock 10 of the invention illustrated in FIGS. 1 through 4 and comprises a body portion 11 which is made of metal tubing as for example aluminum or steel tubing into which one end 17 of a cable 12 is extended and then the portion 18 of the tube is placed in a press and squeezed flat so as to form at least one flat surface 18 upon which identification legend 19 can be printed to identify the seal. During the squeezing process, the tube locks the end 17 of the cable in the tube body portion 11. A transverse opening 22 is formed through the tube in the unflatted portion and the end 21 of the tube is provided with internal threads 24 so that a set screw 26 can be threadedly received therein so as to lock the free end 13 of the cable to the tube after it has been inserted through the opening 22 as illustrated in FIG. 4. The head 27 of the set screw 26 attaches to the threaded cross-sectional area portion such that when the set screw is tightened to lock the cable as shown in FIG. 4 the head 27 will then break off at the reduced cross-sectional portion 28. The head 27 may be formed with a hex or a Phillips head or be adapted to receive other types of wrenches so as to allow the set screw to be tightened and the head to then be broken away from the set screw. In use, as shown in FIG. 1, the cable portion passing through the openings 33 of the hasps 31 and 32 should be made as tight as possible so as to minimize the amount of cable in the loop and the serial number 19 should always be mounted so it extends outwardly so it can be easily inspected.

Since the head has been broken away if the screw tube lock is tampered with, it will be necessary for a thief to cut the cable 12 since he will be unable to remove the set screw 26 after the head 27 has been broken away. Of course, if the cable 12 has been cut, the integrity of the seal is immediately destroyed and the fact that the seal has been broken will be immediately obvious to any inspector.

FIGS. 5, 6 and 7 illustrate a modification of the invention comprising a bolt 41 such as a carriage bolt with a head 42 which has a threaded portion upon which a cylindrical threaded member 43 can be received. A portion 47 of the bolt 41 is reduced in cross-section and an opening 48 is formed in the cylindrical member 43 and is threaded so as to receive a set screw 48 therein. The set screw 48 may have a hex head with a reduced cross-sectional portion 52 such that after the cylindrical portion has been threaded onto the end of the bolt 41, the set screw 49 can be threaded into the opening 48 so as to engage the bolt 41 in the groove 47 after which the head 51 can be broken away at the reduced cross-sectional area 52 to prevent the set screw 49 from being removed from the cylindrical portion 43. The opening 44 of the cylindrical portion 43 does not extend to the end of the cylindrical member so it will be impossible to remove the cylindrical member 43 from the bolt by turning it to unthread it from the bolt due to the broken off set screw 49 which locks the two members together. FIG. 5 illustrates the bolt in place locking a pair of hasps 55 and 56 which are formed with a suitable opening for receiving the bolt 41 therethrough.

It is seen that the invention provides a new and novel locking means and although it has been described with respect to preferred embodiments, it is not to be so limited as changes and modifications may be made therein which are within the full intended scope of the invention as defined by the appended claims.

I claim as my invention:

1. A screw tube lock comprising a tube member with a central opening, one end of a flexible cable received within said one end of said central opening and locked within said tube member by pressure to form a flattened portion on said tube member, indicia printed on said flattened portion, a transverse opening formed through said tube member adjacent the second end, the second end of said flexible cable receivable in said transverse opening, and a locking means engageable with said cable to lock it in said transverse opening.

2. A screw tube lock according to claim 1 wherein said locking means comprises a set screw receivable into a threaded portion of said central opening to lock said cable in said transverse opening.

3. A screw tube lock according to claim 2 wherein said set screw is formed with a reduced cross-section so that it can be broken off after being inserted into said central opening so that said retained screw does not extend beyond the confines of said tube member.

4. A screw tube lock according to claim 3 wherein said set screw has a hex head which can be tightened with a hex wrench.

5. A screw tube lock according to claim 3 wherein said set screw has a Phillips head which can be tightened with a Phillips wrench.

* * * * *